US005785543A

United States Patent [19]

Dietrich

[11] Patent Number: 5,785,543

[45] Date of Patent: Jul. 28, 1998

[54] HIGH VOLTAGE FLASHLAMP CONNECTOR METHOD AND APPARATUS

[75] Inventor: Mark C. Dietrich, Longwood, Fla.

[73] Assignee: Litton Systems, Inc., Woodland Hills, Calif.

[21] Appl. No.: 566,685

[22] Filed: Dec. 4, 1995

[51] Int. Cl.[6] ..... H01R 13/52

[52] U.S. Cl. ..... 439/271; 29/855; 29/858; 439/736; 439/611; 439/936; 313/318.01; 313/318.09; 313/318.1

[58] Field of Search ..... 439/230, 242, 439/280, 736, 611–613, 617, 521; 29/854, 855, 857, 858; 313/318.01, 318.09, 318.1, 318.12

[56] References Cited

U.S. PATENT DOCUMENTS

| | | | |
|---|---|---|---|
| 1,948,166 | 2/1934 | Conradty | 173/358 |
| 3,855,495 | 12/1974 | Pappas et al. | 313/318 |
| 3,999,095 | 12/1976 | Pearce, Jr. et al. | 313/318.1 |
| 4,130,774 | 12/1978 | Cosco et al. | 313/318 |
| 4,326,096 | 4/1982 | Leitmann | 174/84 |
| 4,379,978 | 4/1983 | Hockenbrock | 313/318 |
| 4,496,873 | 1/1985 | Bedu et al. | 313/231.71 |
| 4,804,878 | 2/1989 | Hough et al. | 439/613 |
| 5,149,281 | 9/1992 | Hills et al. | 439/521 |
| 5,343,370 | 8/1994 | Ohashi et al. | 362/61 |
| 5,412,275 | 5/1995 | Dorsemagen et al. | 313/318.01 |
| 5,486,988 | 1/1996 | Tyson | 362/267 |

*Primary Examiner*—Gary F. Paumen
*Assistant Examiner*—Brian J. Biggi
*Attorney, Agent, or Firm*—William M. Hobby, III

[57] ABSTRACT

A high voltage flashlamp connector includes a housing having a well formed therein intersecting a flashlamp supporting opening and having a female connector positioned in the well and aligned with the intersecting flashlamp opening. An electrical conductor is attached through the well to the female connector and the well is filled with an encapsulate forming a seat for the housing. The method includes forming the outer shell of the apparatus of a glass-filled polyphenylene oxide having a well and a flashlamp insert opening having an annular groove formed therein and attaching a high voltage electrical conductor to the female connector which is placed in the outer shell well positioned within the flashlamp opening, and cleaning the shell surfaces, and filling the shell with an encapsulate with a mold pin positioned in the flashlamp opening, and then inserting an O-ring seal and attaching a flashlamp.

4 Claims, 1 Drawing Sheet

HIGH VOLTAGE FLASHLAMP CONNECTOR METHOD AND APPARATUS

BACKGROUND OF THE INVENTION

The present invention relates to a method and apparatus of making a high voltage flashlamp connector and especially to a connector for laser flashlamps capable of operating in low pressure environments. Laser flashlamps are commonly used to pump laser materials in certain types of lasers. The flashlamp is a gas filled lamp which is excited by a high voltage electrical pulse passing through the gas filled lamp to admit a short bright flash of light. The flashlamp produces a broad range of wavelengths which can be selected depending on the gas or gases used within the flashlamp. Since flashlamps typically use a high voltage for excitation, it requires a high voltage connection on each end of the flashlamp. Typically, the connectors support the flashlamp at each end. The flashlamps are sometimes required to operate at high altitudes in low pressure conditions which can result in arcing to the surrounding metal chassis in the laser application. This in turn, can result in missed laser pulses due to loss potential across the flashlamp.

The present invention is directed towards a high voltage connector capable of operating at high altitudes and low pressure without arcing to the surrounding metal chassis so as to eliminate missed laser pulses due to a false potential across a flashlamp.

Prior art lamp connectors can be seen in the Hockenbrock U.S. Pat. No. 4,379,978, for a means and method making an electrical connection to a cathode ray tube. The terminating wires of the cathode ray tube are connected to conductors and are isolated from each other with an insulated adhesive formed in a base shell. In the Conradty U.S. Pat. No. 1,948,166, a holder for an incandescent lamp has an electrical conductor connected in the holder and surrounded by an embedding material. The Leitmann U.S. Pat. No. 4,326,096, is for an electrical connector for use in high voltage circuits and includes a clip which makes electrical contact with a terminal and has an electrical lead connected thereto. The clip is mounted inside a cover piece filled with an adhesive of a rubber-like insulated material to embed the clip therein with a portion of the lead to the clip. The Pappas et al. U.S. Pat. No. 3,855,495, is a flash tube with an insulator end cap and is for an injection triggered xenon flash tube having an elongated glass envelope with an electrode at each end and a pair of caps which connect to an electrical conductor. The glass envelope at each end is secured with an insulating adhesive attaching a tubular metal terminal portion. The Cosco et al. U.S. Pat. No. 4,130,774, is a flash tube having an improved end cap construction in which a flash tube has a lead-in wire extending through the end of the flash tube. An end cap is bonded to the flash tube with a bonding material which is a hard setting ceramic type cement. The Hills et al. U.S. Pat. No. 5,149,281, is a test enabling terminal enclosure apparatus and method which includes a gel filled enclosure for protecting an electrical contact member connection and allows a probe to be inserted into the gel filled enclosure cavity. An electrical conductor feeds through the gel filled enclosure to form the contacts.

The present invention, like the Pappas et al. patent and the Cosco et al. patent, is directed towards a connector for a flash tube of the type typically used in a laser. The present invention, however, is for a high voltage connector which is capable of operating in a low pressure environment without arcing to the surrounding metal chassis and without the resulting missed laser pulses due to the loss potential across the flashlamp which results from the arcing.

SUMMARY OF THE INVENTION

A high voltage flashlamp connector includes a housing having a well formed therein intersecting a flashlamp supporting opening and having a female connector positioned in the well and aligned with the intersecting flashlamp opening. An electrical conductor is attached through the well to the female connector and the well is filled with an encapsulate forming a seat for the housing. The method includes forming the outer shell of the apparatus of a glass-filled polyphenylene oxide having a well and a flashlamp insert opening having an annular groove formed therein and attaching a high voltage electrical conductor to the female connector which is placed in the outer shell well positioned with the flashlamp opening. The steps of the process also include cleaning the shell surfaces, and filling the shell with an encapsulate while a mold pin is positioned in the flashlamp opening, and then inserting an O-ring seal and attaching a flashlamp.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
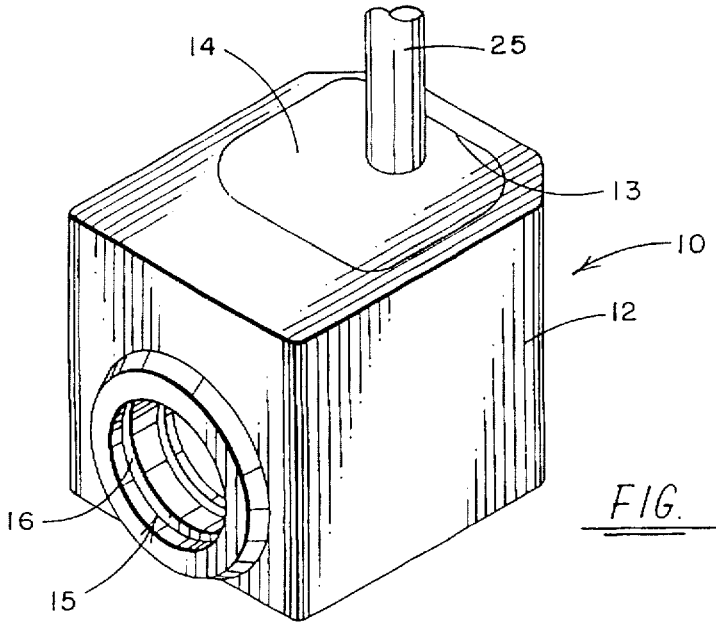
FIG. 1 is a perspective view of a high voltage laser flashlamp connector in accordance with the present invention.
Figure 2:
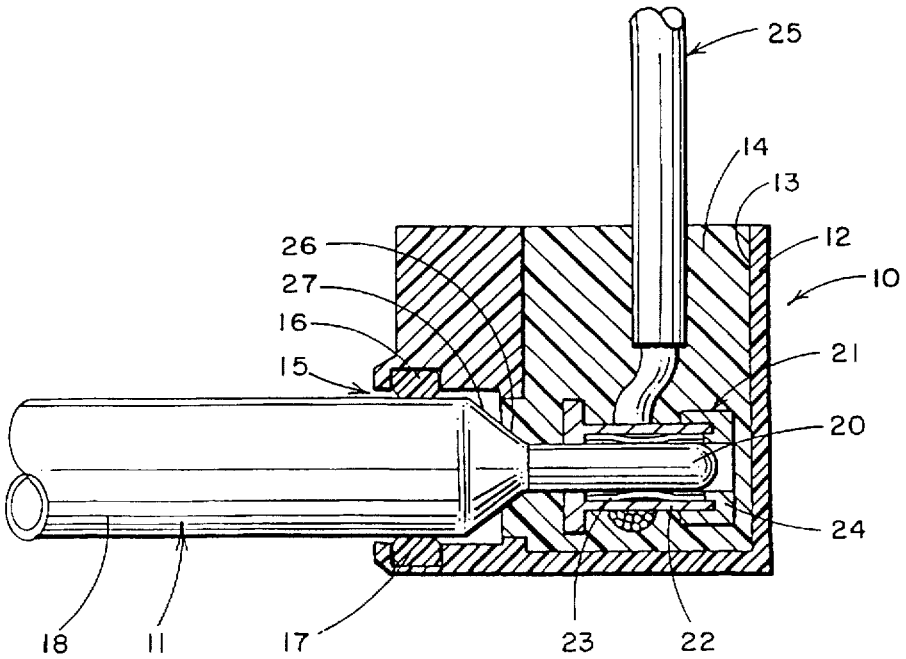
FIG. 2 is a sectional view taken through the connector of FIG. 1 and having a flashlamp connected thereto.

Referring to FIGS. 1 and 2 of the drawings, a high voltage laser flashlamp connector 10 is illustrated for use in a low pressure environment, such as at high altitude. The connection 10 allows a connection to be made to a flashlamp 11 such that the flashlamp operating at high altitudes will not arc to the surrounding metal chassis and thereby eliminates missed laser pulses due to loss potential across the flashlamp 11. A connector consists of a machined glass filled polyphenylene oxide outer shell 12 having a well 13 formed therein which well provides an encasement for an encapsulant 14. It also contains the opening 15 for the supporting of the flashlamp 11. The opening 15 has an annular formed groove 16 for supporting an O-ring 17 for supporting the glass portion 18 of the flashlamp 11. The flashlamp connector 20 is connected to the glass envelope 18. Inside the shell or housing 12, a three piece female electrical contact 21 is provided to transfer an electrical current to the electrode 20 of the laser flashlamp 11. The contact 21 outer contact housing 22 is a silver plated brass alloy 360° tube. Internal to the contact housing is a circular band of gold plated beryllium copper spring fingers 23. The fingers 23 are captured and supported in the tube 22 by an end cap 24 which is bonded in place after the spring fingers are inserted. A silicone coated FEP jacketed, high voltage cable 25 is soldered to the exterior diameter of the contact housing 22. The well 13 is filled with an encapsulant, such as an R2V8111 silicone encapsulant while the O-ring 17 may be a silicone O-ring inserted into the annular ring supporting groove 16.

The connector 10 is normally made by having the outer shell 12 made of a glass filled polyphenylene oxide to form the container having the well 13 extending in one side with the flashlamp opening 15 opening in a second side. The female contact 21 has the high voltage electrical conductor 25 attached thereto and located within the well 13 with a mold pin shaped similar to the one end of the flashlamp 11 (and which my be the flashlamp 11 if desired) inserted in the opening 15 to support the female connector 21 with the conductor 25 attached in the position facing the opening 15 but also to shape the exposed surfaces of the silicone encapsulant 14 so that the silicone encapsulant exposed surface 26 provides an interfacial seal along the electrode 20 and across the glass face 27 of the flashlamp 11. The shell 12 surfaces are then prepared using an acetone to clean the shell and produce the maximum adhesion between the polyphenylene oxide shell 12 and the silicone encapsulant 14. The well 13 is then filled with the encapsulant 14 and allowed to cure.

The final assembly step is to insert the silicone O-ring 17, which may be a 0.217×0.059 O-ring, into the interior of the annular groove 16 of the connector shell or housing 12. The O-ring then provides the radial compression along the exterior of the flashlamp 11 glass envelope 18. This seal, in combination with the facial seal of the silicone encapsulant along the surface 26, produces the dielectric hold-off strength required to operate the laser flashlamp at 10 kilovolts in a low pressure environment. The sealing between the flashlamp 11 and the connector 10 blocks any direct air path to the ground, allowing the connector 10 to be used in low pressure environments down to 1.7 psi without loss of dielectric strength.

It should be clear at this time that a high voltage laser flashlamp connector and method of making a flashlamp has been provided which can be utilized in low pressure environments and which relies on easily controlled flashlamp glass circumference and a primarily dielectrical seal. In addition, a secondary seal around the electrode and at the axial face of the flashlamp increases the reliability while the encapsulated spring finger contacts produce a reliable contact for the connection. Excellent adhesion between the encapsulant and the silicone coated cable also produces a reliable seal for the connector. However, it should be clear that the present invention is not to be considered as limited to the forms shown which is to be considered illustrative rather than restrictive.

I claim:

1. A method of making a high voltage flashlamp connector comprising the steps of:

forming an outer shell having a well therein having a wall opening and a flashlamp insert opening having an annular groove formed in the inside thereof;

attaching a high voltage electrical conductor to a female connector:

placing said female connector with said attached electrical conductor in said shell well;

positioning said female connector in said well aligned with said insert opening with a mold pin;

cleaning said shell surfaces;

filling said shell well with an encapsulant;

inserting an O-ring seal into said outer shell flashlamp insert opening annular groove; and attaching one end of a flashlamp, whereby a flashlamp is supported in a high voltage connector.

2. A method of making a high voltage flashlamp connector in accordance with claim 1 in which the step of forming the outer shell includes forming the outer shell of a composite of polyphenylene oxide and glass.

3. A method of making a high voltage flashlamp connector in accordance with claim 1 in which the step of filling said shell well with an encapsulate includes filling said shell well with a silicone encapsulate.

4. A high voltage flashlamp connector comprising:

a polyphenylene oxide and glass composite housing having a well with a well opening formed therein and an intersecting flashlamp supporting opening for removably supporting one end of a flashlamp;

a female connector positioned in said well and aligned to removably receive a flashlamp electrode through said housing flashlamp intersecting opening;

an electrical conductor attached through said well to said female connector;

a silicone encapsulant filling said well and having a shaped surface in said housing flashlamp intersecting opening; and said housing having an annular groove formed on the interior of said intersecting flashlamp supporting opening and having an O-ring seal mounted therein; whereby a high voltage flashlamp can be supported in a high voltage connector.

* * * * *